US008033365B2

(12) United States Patent
Kassan et al.

(10) Patent No.: US 8,033,365 B2
(45) Date of Patent: Oct. 11, 2011

(54) MAGNETIC RAIL BRAKE DEVICE WITH ASYMMETRIC EXCITATION COILS AND/OR WITH MULTI-PART COILS

(75) Inventors: Michael Kassan, Steinabrückl (AT); Henry Lehmann, Hinterbrühl (AT)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 0 days.

(21) Appl. No.: 12/531,977

(22) PCT Filed: Mar. 20, 2008

(86) PCT No.: PCT/EP2008/002249

§ 371 (c)(1),
(2), (4) Date: Sep. 18, 2009

(87) PCT Pub. No.: WO2008/116597

PCT Pub. Date: Oct. 2, 2008

(65) Prior Publication Data

US 2010/0101898 A1 Apr. 29, 2010

(30) Foreign Application Priority Data

Mar. 23, 2007 (DE) ..... 10 2007 014 717

(51) Int. Cl.
*F16D 69/04* (2006.01)

(52) U.S. Cl. ..... 188/165

(58) Field of Classification Search ..... 188/251 A, 188/251 M, 165, 162–164; 310/77, 93, 103
See application file for complete search history.

(56) References Cited

U.S. PATENT DOCUMENTS

| | | | | |
|---|---|---|---|---|
| 458,871 | A | 9/1891 | Van Depoele | |
| 6,648,108 | B2 * | 11/2003 | Grupp et al. | 188/165 |
| 6,953,107 | B2 | 10/2005 | Lehmann et al. | |

FOREIGN PATENT DOCUMENTS

| | | |
|---|---|---|
| DE | 237401 | 8/1911 |
| DE | 667 025 | 11/1938 |
| DE | 1 123 359 | 8/1962 |
| DE | 196 19 409 | 11/1997 |
| DE | 101 11 685 | 9/2002 |
| DE | 10 2004 018 008 | 12/2005 |
| EP | 0 010 815 | 5/1980 |
| EP | 1 477 382 | 11/2004 |
| FR | 359.101 | 11/1905 |
| FR | 1.003.173 | 3/1952 |
| GB | 458911 | 12/1936 |

* cited by examiner

*Primary Examiner* — Christopher Schwartz
(74) *Attorney, Agent, or Firm* — Barnes & Thornburg LLP

(57) ABSTRACT

A magnetic rail brake device includes a brake magnet with a solenoid former supporting a solenoid. A horseshoe-shaped magnet core is disposed adjacent to the solenoid former. The horseshoe-shaped magnet core includes a yoke having cheeks that project away from the yoke. Pole shoes are formed at ends of the cheeks. The solenoid includes an upper part, with an upper height and an upper width, and a lower part, with a lower height and a lower width. The solenoid is disposed between the cheeks and engages vertically around the yoke. The upper height is less than the lower height, and the upper width is greater than the lower width. The upper and lower heights are measured parallel to a vertical center axis of the brake magnet, and the upper and lower widths are measured transversely with respect to the vertical center axis.

17 Claims, 4 Drawing Sheets

MAGNETIC RAIL BRAKE DEVICE WITH ASYMMETRIC EXCITATION COILS AND/OR WITH MULTI-PART COILS

CROSS-REFERENCE TO RELATED APPLICATION(S)

This United States Non-Provisional Patent Application is a National Stage Patent Application that relies for priority on PCT Patent Application No. PCT/EP2008/002249, filed on Mar. 20, 2008, and on German Patent Application No. DE 10 2007 014 717.3, filed on Mar. 23, 2007, the contents of both of which are incorporated herein by reference.

FIELD OF THE INVENTION

The present invention relates to a magnetic rail brake device. More specifically, the present invention relates to a magnetic rail brake device of a rail vehicle, containing at least one brake magnet with a solenoid former which supports at least one solenoid, and with a horseshoe-shaped magnet core with a yoke and with cheeks which project away from the latter and on whose ends facing a vehicle rail pole shoes are formed, the at least one solenoid engaging vertically around the yoke with an upper part and with a lower part which is arranged between the cheeks.

Furthermore, the invention relates to a magnetic rail brake device of a rail vehicle, containing at least one brake magnet with a solenoid former which supports at least one solenoid, and with at least one magnet core on whose ends facing a vehicle rail pole shoes are formed.

DESCRIPTION OF THE RELATED ART

Magnetic rail brake devices are known, for example, from DE 101 11 685 A1. In that reference, the force-generating main component of an electric magnetic rail brake is the brake magnet. The brake magnet is in principle an electromagnet composed of a solenoid which extends in the direction of the rail and is supported by a solenoid former. A horseshoe-like magnet core forms the base element or carrier element. The horseshoe-shaped magnet core forms pole shoes on its side. The horseshoe-like magnet is turned toward the vehicle rail. The direct current, which flows in the solenoid, produces a magnetic voltage which generates a magnetic flux in the magnet core, which magnetic flux is short circuited across the rail head as soon as the brake magnet rests with its pole shoes on the rail. As a result, a magnetic attraction force comes about between the brake magnet and rail. As a result of the kinetic energy of the moving rail vehicle, the magnetic rail brake is pulled along the rail by means of drivers. This gives rise to a braking force as a result of the sliding friction between the brake magnet and rail in conjunction with the magnetic attraction force. As a result of the frictional contact with the rail, frictional wear is produced on the pole shoes of the brake magnet. The frictional wear must not exceed a maximum wear value or else the solenoid former is damaged.

In the known brake magnet, a single solenoid is provided which engages vertically around the yoke of the magnet core, where an upper part and a lower part are arranged between the cheeks. In this context, the cross section of the solenoid is geometrically identical in the region of the upper part and in the region of the lower part.

In principle, two different types of magnets can be differentiated according to the structural design.

In a first embodiment, the brake magnet is a rigid magnet to which two magnetic pole shoes, which are separated in the longitudinal direction by a nonmagnetic bar, are screwed. This serves to avoid a magnetic short circuit within the brake magnet. The pole shoes are formed on the end faces of the side cheeks facing the vehicle rail. Rigid magnets are usually used in local streetcar and urban railroads.

Furthermore, link magnets are known in which the solenoid former does not have a steel core but rather only dividing walls. Magnet elements, which align themselves during the braking process in order to be able to follow unevennesses on the rail head better, are held in such a way that they can move to a limited degree in the chambers between the dividing walls. In this case, the pole shoes are formed on those ends of the magnet elements which are turned toward the rail. Link magnets are used on a standard basis in main-line track services.

With respect to the embodiments of magnetic rail brakes, reference is made to the publication "Grundlagen der Bremstechnik [The bases of brake technology]", pages 92 to 97 from Knorr-Bremse AG, Munich, 2002.

The magnitude of the braking force of a magnetic rail brake is dependent, inter alia, on the magnetic resistance of the magnetic circuit, i.e. the geometry and permeability, the magnetic flux, the coefficient of friction between the brake magnet and rail and the state of the rail. An essential factor here is also the magnetic losses which depend decisively on the geometric design of the magnetic cross section. In view of the fact that the space available in the running gear of rail vehicles is increasingly restricted, in particular in the vertical direction, a small overall height is also required.

SUMMARY OF THE INVENTION

An object of the invention is therefore to develop a magnetic rail brake device that has a relatively small overall height, while at the same time having a high magnetic force.

A solenoid is to be understood in the text which follows as referring to the coil winding composed of the turns of the winding wires such as are wound onto the solenoid former. This coil winding, which is wound onto the solenoid former or solenoid, has, when viewed in a plane perpendicular to the longitudinal extent of the brake magnet (parallel to the rail), a specific cross section. The cross section depends both on the number of turns, the winding density and the diameter of the wire. The cross section also depends on the geometry of the solenoid former, i.e., it depends on the space made available for the coil winding. In this context, according to a first aspect, the invention differentiates between an upper part of the solenoid, which is located above a yoke with respect to the rail, and a lower part which is arranged below the yoke.

The longitudinal direction of the brake magnet is intended to refer to the extent of the rigid magnet or of the link magnets parallel to the vehicle rail.

According to the first aspect of the invention, the cross section of the at least one solenoid has, in the upper part, a smaller height and a greater width than the cross section in the lower part. The height of the cross section of the solenoid is measured parallel to a vertical center axis of the brake magnet. The width of the cross section of the solenoid is measured transversely with respect to a vertical center axis of the brake magnet. In the region of the upper part of the solenoid, a wider embodiment of the cross section compared to the prior art is not disruptive. In contrast, for a given number of turns of the solenoid winding, the height of the cross section decreases in the region of the upper part, which advantageously brings about a reduction in the overall height of the brake magnet compared to the prior art, while the magnetic force is the same as the prior art. On the other hand, in the region of the lower part, a greater height of the cross section of the solenoid can be permitted without entailing disadvantages with respect to the overall height of the brake magnet, because, at that location, the cheeks or the pole shoes of the magnet core cannot be shortened to any desired degree owing to the need for a minimum wear height. Instead of a relatively high brake magnet for achieving a predefined braking force, the brake magnet can then be made lower in accordance with the invention.

According to a further aspect of the invention, at least two solenoid formers, which are arranged parallel to one another when viewed in the longitudinal direction of the brake magnet and are arranged one next to the other when viewed in a plane perpendicular to the longitudinal direction, are provided with respectively separate solenoids. By virtue of the arrangement of the solenoids one next to the other, the magnetic power is distributed over the width so that it is also possible to achieve a relatively small overall height accompanied by a magnetic force which is the same as in the prior art.

Overall, owing to the relatively small overall height of the brake magnet, lower losses occur in the magnetic circuit, the power requirements are lower and the mass is lower.

As a result of the measures specified herein, advantageous developments and improvements of the invention are possible.

In order to implement the first aspect of the invention, for example, the number of layers of coil wire turns of the solenoid which lie one on top of the other is lower in the region of the upper part than in the region of the lower part.

According to one development of the first aspect, the cross section of the solenoid in the upper part is formed essentially in the shape of a rectangle with the longer side perpendicular with respect to the vertical center axis of the brake magnet. The cross section of the solenoid in the lower part is formed essentially in a square shape. The cross-sectional faces of the solenoid are preferably of essentially the same size in the upper part and in the lower part.

One development of the second aspect of the invention provides that, when viewed in a plane perpendicular to the longitudinal direction of the brake magnet, the center axes of the at least two solenoid formers are arranged at an acute or obtuse angle with respect to a vertical center axis of the brake magnet. Alternatively, the center axes are arranged parallel, for example symmetrically, with the center axes of the at least two solenoid formers converging or diverging with respect to the vehicle rail. The oblique position of the coil formers, which is then assumed with respect to the vertical center axis of the brake magnet, produces a particularly compact design.

Furthermore, in both aspects of the invention the brake magnet can be a link magnet, with at least one solenoid former on which a plurality of magnetic magnet elements are movably held. Alternatively, the brake magnet can be a rigid magnet.

Last but not least, the first aspect of the invention can be combined with the second aspect of the invention by virtue of the fact that the cross section of at least one of the plurality of solenoids according to the second aspect of the invention has, in the upper part, a smaller height and a greater width than the cross section in the upper part, the height of the cross section of the respective solenoid then being measured parallel to the respective center axis of the solenoid former in question and the width of the cross section of the solenoid then being measured transversely with respect to the respective center axis of the solenoid former in question.

BRIEF DESCRIPTION OF THE DRAWINGS

The invention will be explained, by way of the examples below, with reference to the drawings, in which.

DETAILED DESCRIPTION OF EMBODIMENT(S) OF THE INVENTION

The invention will now be described in connection with one or more embodiments. The description of selected embodiments is not intended to convey that the invention is limited thereto. To the contrary, based on the instant disclosure, those skilled in the art should appreciate variations and equivalents of the embodiments. Those variations and equivalents also are intended to fall within the scope of the present invention.

In the following description of the exemplary embodiments, identical or identically acting components and assemblies are identified by the same reference symbols.

Figure 1:
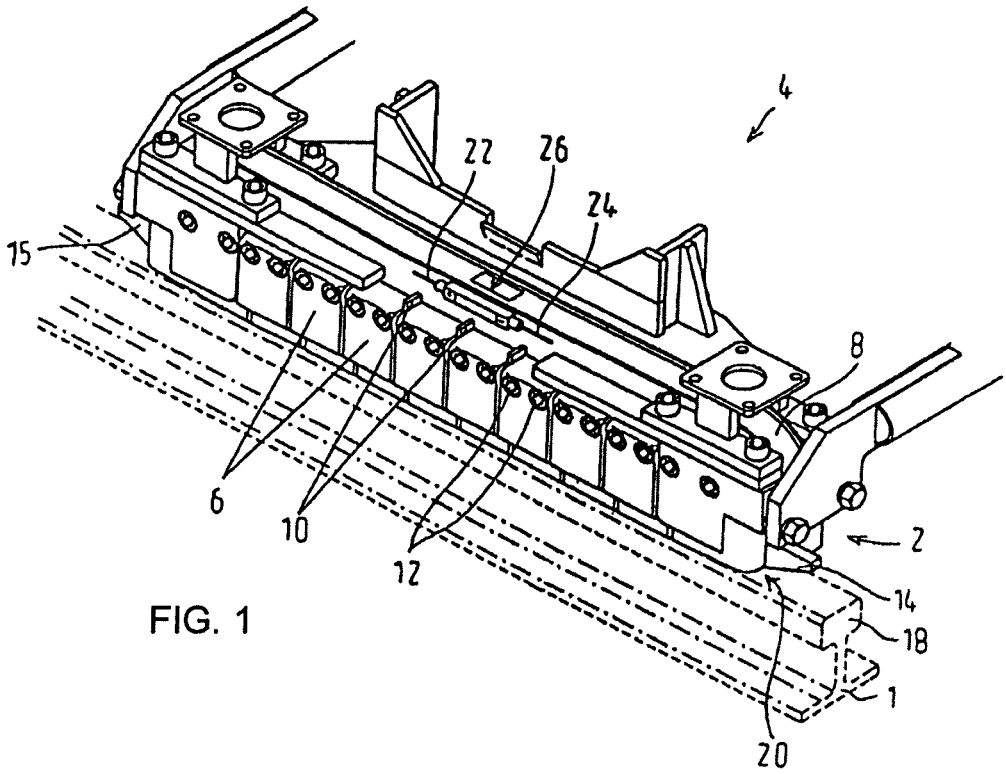
FIG. 1 is a perspective illustration of a magnetic rail brake according to the prior art.
Figure 2:
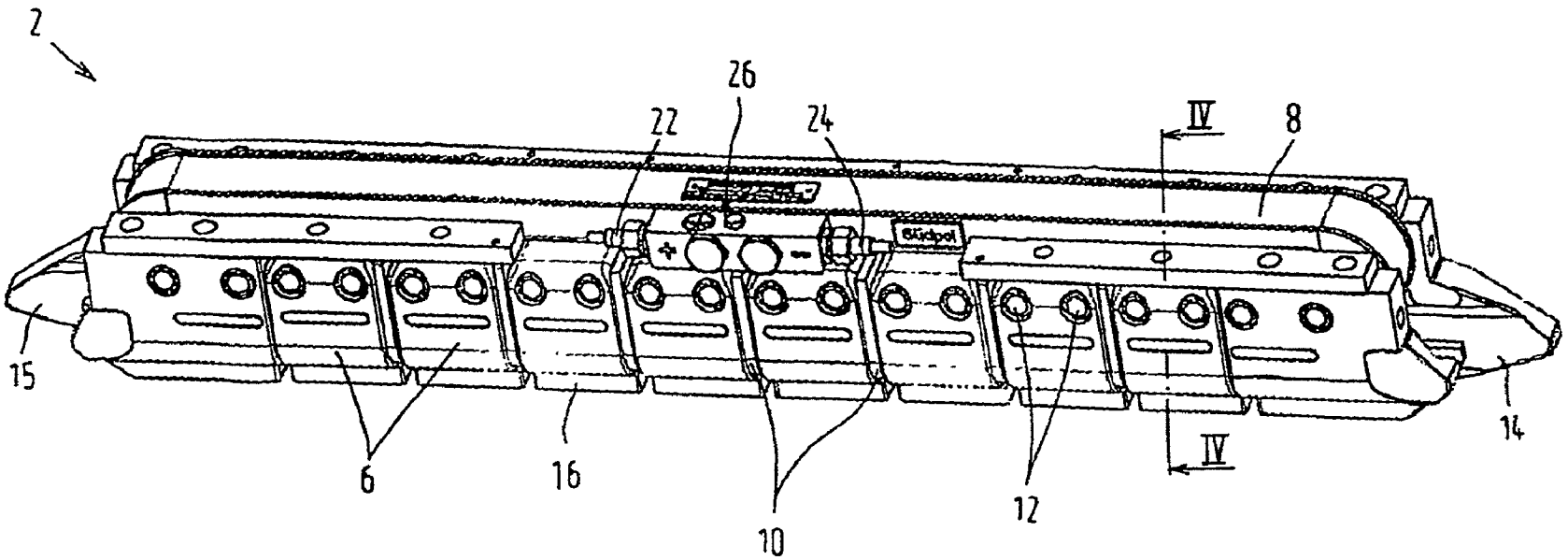
FIG. 2 is a side view of a brake magnet from FIG. 1, which is embodied as a link magnet.

In order to be able to adapt better to unevennesses of a rail 1, a brake magnet 2 (shown in FIG. 1 and FIG. 2) of a magnetic rail brake 4 according to the prior art has, instead of a single rigid magnet, a plurality of magnet elements 6. The magnet elements 6 are held in such a way that they can move to a limited degree on a solenoid former 8, which extends in the longitudinal direction of the rail 1. This is preferably achieved by virtue of the fact that the magnet elements 6 are suspended in such a way that they can pivot or swivel to a limited degree symmetrically with respect to a vertical center axis. This pivoting occurs at the end faces, which face away from one another, of the solenoid former 8, in chambers which are formed between dividing walls 10. The transmission of the braking forces to the solenoid former 8 is then effected via the dividing walls 10 and end pieces 14, 15, which are rigidly connected to the solenoid former 8 and which guide the brake magnet 2 satisfactorily over railway switches and rail joints. The solenoid former 8, which includes a solenoid 9 which cannot be seen from the outside, consequently supports the magnet elements 6, which form a magnet core of the brake magnet 2.

In order to supply the solenoid 9 with electrical voltage, a connecting device 26, which has at least two electrical terminals 22, 24 for the positive pole and minus pole of a voltage source, is provided. The connecting device 26 is arranged, for example, in the upper region of a side face of the solenoid former 8, approximately in the center with respect to its longitudinal extent. The electrical terminals 22, 24 preferably face away from one another and extend in the longitudinal direction of the solenoid former 8.

Figure 3:
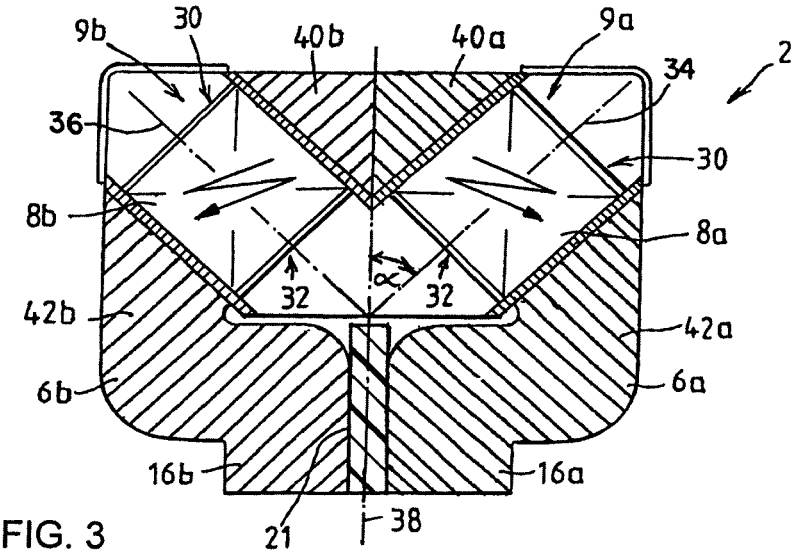
FIG. 3 is a cross-sectional illustration of a magnet link of a link magnet according to a preferred embodiment of the invention.

The preceding description of the prior art has the purpose of explaining the basic design of a magnetic rail brake 4. In contrast to FIG. 1 and FIG. 2, which show a magnetic rail brake 4 with just one solenoid former 8 and just one solenoid 9, FIG. 3 illustrates a cross section of a brake magnet 2 as a link magnet. In this embodiment, at least two solenoid formers 8*a*, 8*b*, which are arranged parallel to one another when viewed in the longitudinal direction of the brake magnet 2 and are arranged one next to the other when viewed in a plane perpendicular to the longitudinal direction, are provided respectively with separate solenoids 9*a*, 9*b*. The solenoids 9*a*, 9*b*, which are wound onto the solenoid formers 8*a*, 8*b*, can be connected separately, in series with one another or parallel to one another. In other words, the solenoid 9*a*, which is assigned to one of the solenoid formers 8*a*, can be separated from the solenoid 9*b*, which is assigned to the other solenoid former 8*b*, can be connected in series with respect to it, or can be connected parallel to it.

In the cross-sectional plane, which is illustrated in FIG. 3 perpendicular to the longitudinal direction of the brake magnet 2 or in the longitudinal direction of the rail, the center axes 34, 36 of the two solenoid formers 8*a*, 8*b* are arranged at an acute angle $\alpha$ with respect to a vertical center axis 38 of the brake magnet 2 and converge with respect to the rail 1, that is to say in the downward direction. Furthermore, the two solenoid formers 8*a*, 8*b* are arranged symmetrically with respect to the vertical center axis 38 of the brake magnet 2.

Alternatively, the center axes 34, 36 of the two coil formers 8*a*, 8*b* could also be arranged at an obtuse angle with respect to the vertical center axis 38 or could diverge toward the rail 1. The coil windings 9*a*, 9*b*, which are not illustrated explicitly in FIG. 3 but are represented by their reference numbers and are composed of the turns of the winding wires, are wrapped around the solenoid formers 8*a*, 8*b* in a direction which is parallel to the center axes 34, 36.

In the present case, the magnet core 6 is also formed so as to be symmetrical with respect to the vertical center axis 38 of the brake magnet 2. The magnet core 6 is of multi-component design, here preferably two-component design, with one half 6*a*, 6*b* of the magnet core respectively having a limb 40*a*, 40*b* which projects through an opening in the solenoid former 8*a*, 8*b* in question. The limbs 40*a*, 40*b* abut one another in a plane containing the vertical center axis 38. The limbs 40*a*, 40*b* of the halves 6*a*, 6*b* of the magnet core adjoin cheeks 42*a*, 42*b*, which extend parallel to one another toward the rail 1 and on whose ends, facing the rail 1, pole shoes 16*a*, 16*b* (respectively north and south poles) of the brake magnet 2 are formed. An air gap 20 (FIG. 1) is then provided between the pole shoes 16*a*, 16*b* and a rail head 18 of the rail 1, as in the prior art. The pole shoes 16*a*, 16*b* are preferably composed of a friction material, for example of steel, nodular cast iron or of sintered materials, and are preferably connected releasably to the cheeks 42*a*, 42*b* as separate components. A nonmagnetic, wear-resistant, impact-resistant and thermally resistant intermediate strip 21 may be arranged in an intermediate space between the left-hand and right-hand pole shoes 16*a*, 16*b* (magnetic north pole or south pole) in such a way that it fills the intermediate space.

With respect to the longitudinal extent of the brake magnet, the halves 6*a*, 6*b* of the magnet core of each link magnet 6 are movably held in a frame. The frame is formed by the solenoid formers 8*a*, 8*b*, which are preferably connected to one another, so that they can adapt themselves to the unevennesses of the rail 1.

Figure 4:
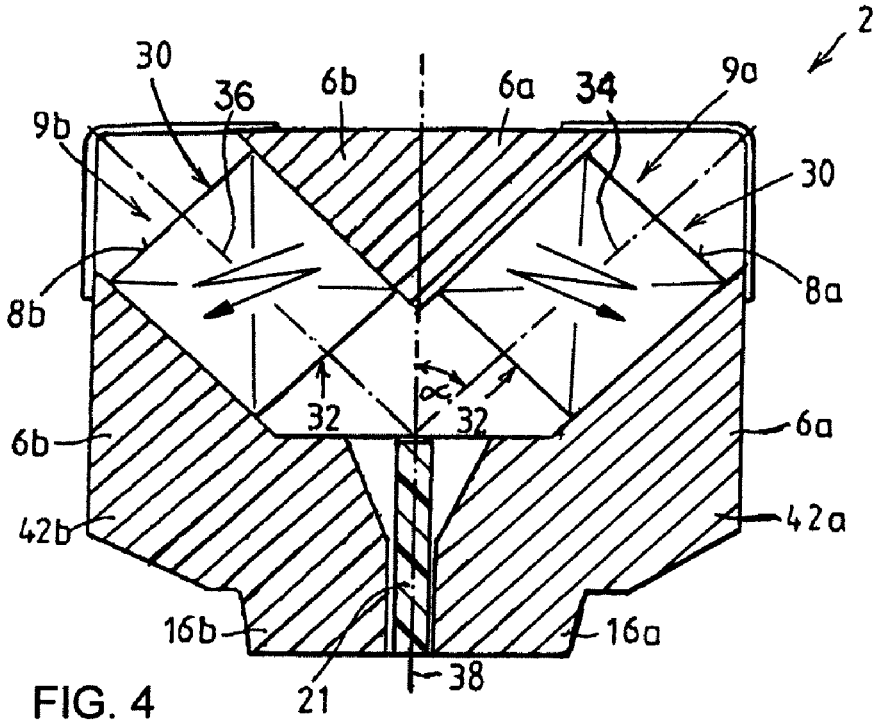
FIG. 4 is a cross-sectional illustration of a rigid magnet according to a preferred embodiment of the invention.

In contrast, FIG. 4 shows the cross section of a rigid magnet 2 as a brake magnet in which the magnet core 6 is, preferably, also of two-component design. The magnet core 6 is composed of two halves 6*a*, 6*b*, which are rigidly connected to one another. The coil former 8 is not a separate component here but is rather formed by faces 8*a*, 8*b* of the magnet core 6. More precisely, the coil former is formed from the halves 6*a*, 6*b* of the magnet core onto which the turns of the wire windings of the two solenoids 9*a*, 9*b* are preferably directly wound. Otherwise, the position and geometry of the solenoids 9*a*, 9*b* and of the solenoid formers 8*a*, 8*b* corresponds to the description of the preceding exemplary embodiment.

Figure 5:
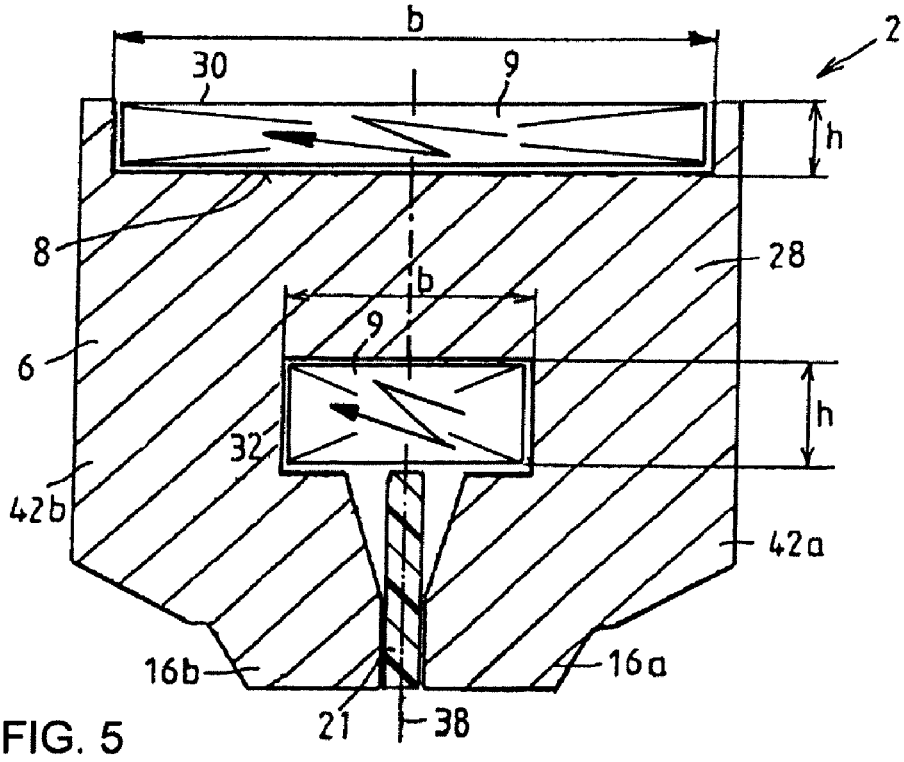
FIG. 5 is a cross-sectional illustration of a rigid magnet according to a further embodiment of the invention.

FIG. 5 shows the cross section through a rigid magnet 2 in which the preferably single-piece magnet core 6 is formed in the shape of a horseshoe. The horseshoe shape includes a yoke 28 and cheeks 42*a*, 42*b*. The cheeks 42*a*, 42*b* extend parallel to one another. The pole shoes 16*a*, 16*b* (respectively north and south poles) of the brake magnet 2 are formed on the ends of the cheeks 42*a*, 42*b*, which face the rail 1. The air gap 20 is then provided between the pole shoes 16*a*, 16*b* and the rail head 18 of the rail 1 (see FIG. 1). The pole shoes 16*a*, 16*b* are preferably composed, as in the preceding exemplary embodiment, of a frictional material, for example of steel, nodular cast iron or of sintered materials. As in the preceding exemplary embodiments, a nonmagnetic, wear-resistant, impact-resistant and thermally resistant intermediate strip 21 can be arranged in an intermediate space between the left-hand and the right-hand pole shoes 16*a*, 16*b* (magnetic north pole or south pole) in such a way that it fills the intermediate space.

The solenoid 9 engages vertically around the yoke 28 with an upper part 30 and with a lower part 32 is arranged between the cheeks 42*a*, 42*b*. In this context, the cross section of the solenoid 9 has, in the upper part 30, a smaller height h and a greater width b than the cross section in the lower part 32. The height h of the cross section of the solenoid 9 is measured parallel to a vertical center axis 38 of the brake magnet 2. The width b of the cross section of the solenoid 9 is measured transversely with respect to a vertical center axis 38 of the brake magnet 2.

For the purpose of implementation, for example, the number of layers of coil wire (which lie on top of one another) and make up the turns of the solenoid 9 is lower in the region of the upper part 30 than in the region of the lower part 32. In particular, the cross section of the solenoid 9 in the upper part 30 is formed essentially in the shape of a rectangle with the longer side being perpendicular with respect to the vertical center axis 38 of the brake magnet 2, The cross section of the solenoid 9 in the lower part 32 is formed essentially in a square shape. The cross-sectional faces of the solenoid 9 are preferably of essentially the same size in the upper part 30 and in the lower part 32.

Figure 6:
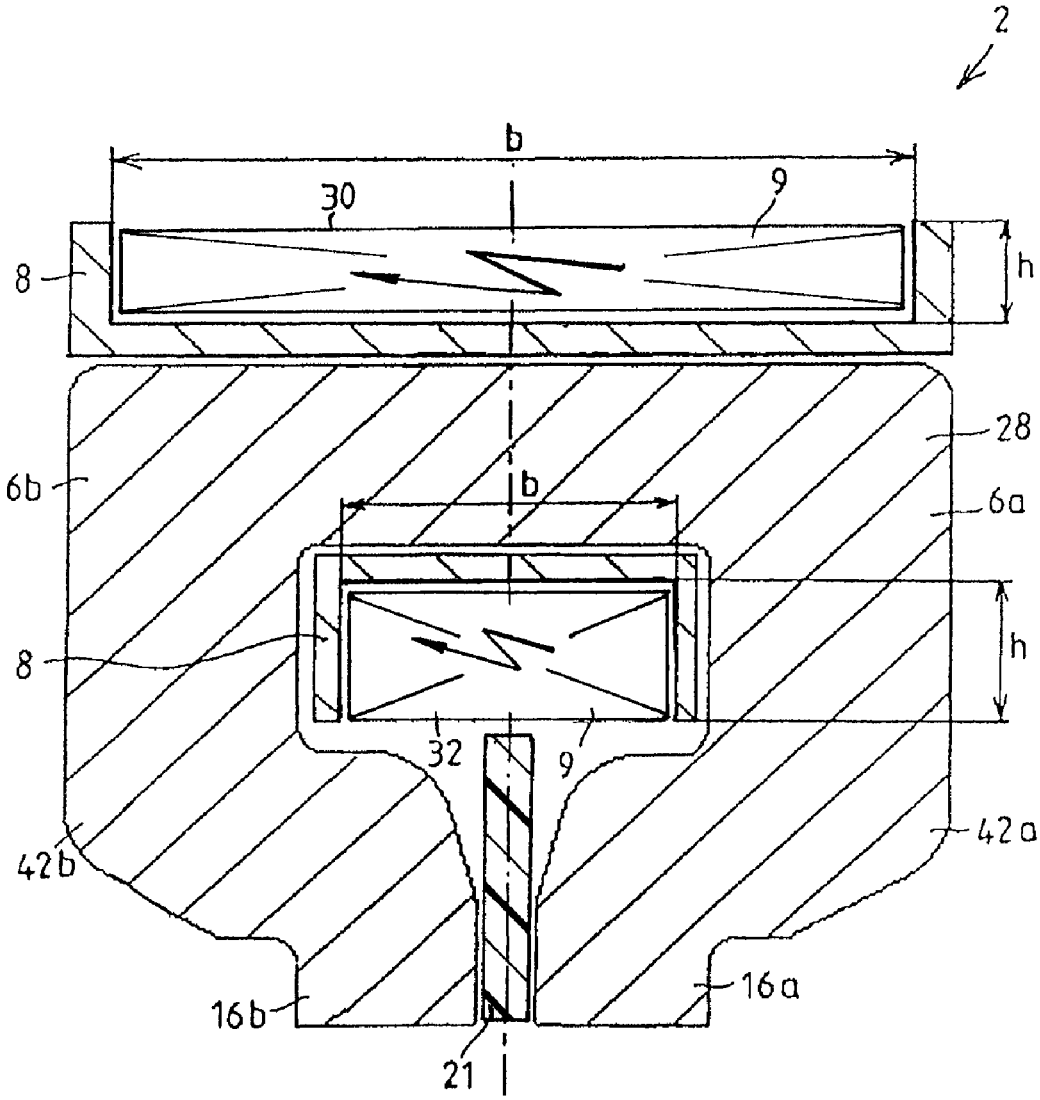
FIG. 6 is a cross-sectional illustration of a magnet link of a link magnet according to a further embodiment of the invention.

According to a further embodiment, which is shown in FIG. 6, the principle of the asymmetric coil 9 according to FIG. 5 can also be implemented in a link magnet 2. In this case, the solenoid former 8 is of corresponding design.

An asymmetric design of the coil 9, i.e., a different width b and height h of the coil 9 in the upper part 30 and in the lower part 32, is also obtained if the yoke 28 has a convex shape. A convex shape includes an upwardly rounded or bent shape when viewed in the direction facing away from the rail 1. This is because the width b in the upper part 32 is then automatically greater than the width b in the lower part 32.

According to a further embodiment (not illustrated here), the embodiments according to FIG. 3 and FIG. 4 can be combined with the embodiments according to FIG. 5 and FIG. 6 by virtue of the fact that the cross section of at least one of the solenoids 9*a*, 9*b* of FIG. 3 or FIG. 4 has, in the upper part 30, a smaller height h and a greater width b than the cross section in the lower part 32. In this embodiment, the height h of the cross section of the respective solenoid 9*a*, 9*b* is measured parallel to the respective center axis 34, 36 of the solenoid former 8*a*, 8*b* in question, and the width b of the cross section of the solenoid 9*a*, 9*b* is measured transversely with respect to the respective center axis 34, 36 of the solenoid former 8*a*, 8*b* in question.

Other variations and equivalents should be apparent to those skilled in the art based on the embodiments described herein. As noted above, those variations and equivalents are intended to fall within the scope of the present invention.

The invention claimed is:

1. A magnetic rail brake device of a rail vehicle, comprising:

at least one brake magnet with a solenoid former;

at least one solenoid supported by the solenoid former;

a horseshoe-shaped magnet core disposed adjacent to the solenoid former, wherein the horseshoe-shaped magnet core comprises a yoke having cheeks that project away from the yoke; and pole shoes formed at ends of the cheeks, adapted to face a vehicle rail;

wherein the at least one solenoid comprises an upper part with an upper height and an upper width and a lower part with a lower height and a lower width, wherein the at least one solenoid is disposed between the cheeks, wherein the at least one solenoid engages vertically around the yoke;

wherein the upper height is less than the lower height, wherein the upper width is greater than the lower width, wherein the upper and lower heights are measured parallel to a vertical center axis of the at least one brake magnet and the upper and lower widths are measured transversely with respect to the vertical center axis.

2. The magnetic rail brake device as claimed in claim 1, wherein a cross section of the at least one solenoid in the upper part is formed in the shape of a rectangle with the longer side being perpendicular with respect to the vertical center axis of the at least one brake magnet.

3. The magnetic rail brake device as claimed in claim 2, wherein a cross section of the at least one solenoid in the lower part is formed in a square shape.

4. The magnetic rail brake device as claimed in claim 1, wherein the yoke has a convex, upwardly rounded shape when viewed in a direction facing away from the rail.

5. The magnetic rail brake device as claimed in claim 1, wherein the upper part of the at least one solenoid is substantially rectangular in cross-section, with the longer side being perpendicular to the vertical center axis and the lower part is substantially square in cross-section.

6. The magnetic rail brake device as claimed in claim 1, wherein the upper part and the lower part comprise a number of layers of coil wire turns that lie one on top of the other, and wherein the number of layers in the upper part is less than the number of layers in the lower part.

7. The magnetic rail brake device as claimed in claim 1, wherein a number of layers of coil wire which lie on top of one another and make up turns of the at least one solenoid is lower in the upper part than in the lower part.

8. The magnetic rail brake device as claimed in claim 1, wherein a cross section of the at least one solenoid in the lower part is formed in a square shape.

9. The magnetic rail brake device as claimed in claim 1, wherein cross-sectional faces of the solenoid are the same size in the upper part and in the lower part.

10. A magnetic rail brake device of a rail vehicle, comprising:

at least one brake magnet with at least one solenoid former;

at least one solenoid supported by the at least one solenoid former;

at least one magnet core comprising ends facing a vehicle rail;

pole shoes formed on the ends of the at least one magnet core, wherein the at least one solenoid former is one of at least two solenoid formers being arranged parallel to one another when viewed in a longitudinal direction of the brake magnet and being arranged one next to the other when viewed in a plane perpendicular to the longitudinal direction and wherein the at least one solenoid being one of at least two solenoids, at least one solenoid being provided for each solenoid former, and wherein at least one solenoid comprises an upper part with an upper height and an upper width and a lower part with a lower height and a lower width, wherein the upper height is less than the lower height, wherein the upper width is greater than the lower width, and wherein the upper and lower heights are measured parallel to a vertical center axis of the at least one brake magnet and the upper and lower widths are measured transversely with respect to the vertical center axis.

11. The magnetic rail brake device as claimed in claim 10, wherein center axes of the at least two solenoid formers, when viewed in the plane perpendicular to the longitudinal direction, are arranged with respect to a vertical center axis of the brake magnet in at least one of an acute angle, an obtuse angle, or parallel to one another.

12. The magnetic rail brake device as claimed in claim 11, wherein, when viewed in the plane perpendicular to the longitudinal direction of the brake magnet, the center axes of the at least two solenoid formers at least one of converge or diverge with respect to the vehicle rail.

13. The magnetic rail brake device as claimed in claim 11, wherein, when viewed in a plane perpendicular to the longitudinal direction of the brake magnet, the at least two solenoid formers are arranged symmetrically with respect to the vertical center axis of the brake magnet.

14. The magnetic rail brake device as claimed in claim 10, the at least two solenoids are energized separately and are connected to one another at least one of in series or in parallel.

15. The magnetic rail brake device as claimed in claim 10, wherein a cross section of at least one of the solenoids has, in an upper part, a smaller height and a greater width than a height and width of a cross section in the lower part, the heights being measured parallel to a center axis of the solenoid former and the widths being measured transversely with respect to the center axis of the solenoid former.

16. The magnetic rail brake device as claimed in claim 10, wherein the brake magnet is a link magnet, with the at least one solenoid former having a plurality of magnetic elements movably held thereon.

17. The magnetic rail brake device as claimed in claim 10, wherein the brake magnet is a rigid magnet.

* * * * *